US007388323B2

(12) United States Patent
Shibata et al.

(10) Patent No.: US 7,388,323 B2
(45) Date of Patent: Jun. 17, 2008

(54) SPARK PLUG

(75) Inventors: Tsutomu Shibata, Owariasahi (JP); Hiroyuki Tanabe, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 11/246,632

(22) Filed: Oct. 11, 2005

(65) Prior Publication Data

US 2006/0076865 A1 Apr. 13, 2006

(30) Foreign Application Priority Data

Oct. 12, 2004 (JP) ..... P.2004-297250

(51) Int. Cl.
*H01T 13/20* (2006.01)

(52) U.S. Cl. ..... 313/143; 313/118

(58) Field of Classification Search ..... 313/118–142, 313/143

See application file for complete search history.

(56) References Cited

U.S. PATENT DOCUMENTS

| | | | | |
|---|---|---|---|---|
| 4,695,758 | A * | 9/1987 | Nishida et al. | 313/130 |
| 5,619,959 | A * | 4/1997 | Tozzi | 123/143 B |
| 6,160,342 | A * | 12/2000 | Nishikawa et al. | 313/141 |

FOREIGN PATENT DOCUMENTS

| | | | |
|---|---|---|---|
| DE | 39 05 315 A1 | | 8/1990 |
| EP | 1 168 543 A2 | | 1/2002 |
| JP | 61-135079 | | 6/1986 |
| JP | 11185930 | * | 7/1999 |

OTHER PUBLICATIONS

JASO D 004-91; The Society of Automotive Engineers of Japan; Mar. 29, 1991.

* cited by examiner

*Primary Examiner*—Toan Ton
*Assistant Examiner*—Hana A Sanei
(74) *Attorney, Agent, or Firm*—Sughrue Mion, PLLC

(57) ABSTRACT

A spark plug including: an insulator having a through hole extending in an axial direction, the through hole including, a first portion and a second portion provided on a rear end side of the first portion, the second portion having a larger diameter than that of the first portion; a center electrode provided in the first portion; an external terminal provided in the second portion; and a sintered ceramic resistor provided in the second portion. The sintered ceramic resistor is formed from a sintered body of a conductive ceramic, connecting the center electrode and the external terminal electrically, and having a length in an axial direction of 40% or more of a length in an axial direction of the second portion of the through hole.

7 Claims, 13 Drawing Sheets

SPARK PLUG

BACKGROUND OF THE INVENTION

1. Field of the Invention

The present invention relates to a spark plug for use in an internal combustion engine and, more particularly, to a spark plug having a sintered ceramic resistor assembled therein for preventing radio wave noise.

2. Description of the Related Art

A spark plug known in the related art for an internal combustion engine comprises: a cylindrical insulator having a through hole in an axial direction; a center electrode fitted in one end portion of the through hole; an external terminal fitted in the other end portion of the through hole; and a main fitting fitted on the outer circumference of the insulator. Moreover, gas tightness between the center electrode and the external terminal and the through hole of the insulator is maintained by a glass sealing method. In this method a conductive glass seal member substantially composed of a mixture of metal powder and glass powder is filled in the through hole between the center electrode and the external terminal, to thereby make an electric connection between the center electrode and the external terminal.

This engine spark plug generates interfering radio waves at the time of spark discharge which adversely affect various kinds of electronic devices. To address this problem, a spark plug having a resistor has been proposed, which is provided with both functions as spark plug and as a radio wave noise preventer. This resistor spark plug can be broadly classified into a monolithic type and a cartridge type resistor spark plug depending on the properties of the resistor.

The monolithic type spark plug is manufactured (as referred to in JP-A-51-27494, for example): by inserting the center electrode into the through hole of the insulator, filling the through hole on the rear end side of the center electrode with a conductive glass seal material powder of a mixture of glass powder and metal powder, a glass quality resistor composite powder of a mixture of ceramic powder, carbon black, a carbon substance and glass powder, and the conductive glass seal material powder in the recited order, and heating these fillers to a high temperature (e.g., 800° C. to 1,000° C.). The external terminal is thereby hot-pressed in the through hole of the insulator while the conductive glass seal material powder and the glass quality resistor composite powder are softened, so as to seal the space between the center electrode and the external terminal.

This monolithic type spark plug can be manufactured mainly by the step of filling the conductive glass seal material powder and the glass quality resistor composite powder in the through hole of the insulator and heating the filler. As such, this technique requires a small number of manufacturing steps, has excellent productivity and provides a durable product.

On the other hand, the cartridge type spark plug is manufactured: by inserting the center electrode into the through hole of the insulator; filling the conductive glass seal material of a mixture of the glass powder and the metal powder; inserting a coil resistor having an electric resistance material formed helically on the surface of the insulator; filling the conductive glass seal material; and heating those materials to a high temperature (e.g., 800° C. to 1,000° C.) to hot-press the external terminal in the through hole of the insulator and thereby seal the center electrode and the external terminal.

This coil resistor is exemplified by: one (as referred to in JP-A-49-116559, for example), in which a helical groove is formed in the surface of a column-shaped insulator and in which a resistive cover film is formed on the helical groove; by one (as referred to in JP-A-61-135079, for example), in which the column-shaped insulator is printed on its surface with a helical electric resistance material and is sintered; or by one (as referred to in JP-A-1-283784, for example), in which the cover film is made with a specific thickness to set its resistance and temperature dependency. Generally, the cartridge type spark plug using the coil resistor is superior in noise preventing effect as compared to the monolithic type because of less noise current.

3. Problems to be Solved by the Invention

Although the monolithic spark plug has excellent productivity and durability, it is difficult to make the resistor sufficiently long relative to the insulator through hole and to accordingly improve the noise preventing effect. This is because the manufacturing technique is restricted to filling the insulator with the conductive glass seal material powder and the glass quality resistor composite powder, and hot-pressing the external terminal in the through hole of the insulator.

The cartridge type spark plug using the coil resistor provides an excellent noise preventing effect but has insufficient durability. This is because a coil made by an electric resistance material is easily broken. Moreover, in the case that the conductive glass seal material powder is heated for the sealing operation so as to improve gas-tightness, the coil may not endure heating at the requisite high temperature. In order to heat and seal the conductive glass seal material powder, therefore, the use of a sealing terminal has been proposed. In the case of using this sealing terminal, however, the length of the sealing terminal makes it difficult to make the coil resistor sufficiently long relative to the insulator through hole, and accordingly it is difficult to improve the noise preventing effect.

Especially in recent years, increased use of a computer for complicated controls of an internal combustible engine has created a great demand for an effective noise prevention spark plug.

SUMMARY OF THE INVENTION

The present invention has been made to solve the above-noted problems, and an object of the invention is to provide a spark plug having excellent durability, noise preventing effect and productivity.

The above object of the invention has been achieved by providing a spark plug comprising: an insulator having a through hole extending in an axial direction, the through hole including a first portion and a second portion provided on the rear end side of said first portion and having a larger diameter than that of said first portion; a center electrode provided in the first portion of the through hole of said insulator; and an external terminal provided in the second portion of the through hole of said insulator. The spark plug further comprises a sintered ceramic resistor provided in said second portion of the through hole, comprising a sintered body of a conductive ceramic and connecting said center electrode and said external terminal electrically, and wherein said sintered ceramic resistor has an axial length of 40% or more of the axial length of said second portion of the through hole.

According to the invention, a pre-sintered ceramic resistor is inserted into the second portion of the through hole of the insulator so that it can be made sufficiently long without being limited by the manufacturing length of the prior art. As a result, the effective dielectric constant between the center electrode and the external terminal can be lowered so as to reduce the capacitative discharge current at ignition time and to thereby enhance the noise preventing effect.

Moreover, the length (LR) of the sintered ceramic resistor is set to 40% or more of the length (LH) of the second portion of the through hole ((LR/LH)×100≧40) so that the effective dielectric constant between the center electrode and the external terminal and the capacitative discharge current occurring at the time of ignition time can be reduced to achieve a sufficient noise preventing effect. Here, if the length (LR) of the sintered ceramic resistor is less than 40% of the length (LH of the second portion of the through hole, a sufficient effect can hardly be attained. More preferably, the length (LR) of the sintered ceramic resistor is 50% or more of the length (LH) of the second portion of the through hole ((LR/LH)×100≧50).

Preferably, the spark plug of the invention further comprises a sealing portion comprising a glass component for fixing the rear end of the center electrode and the leading end of the sintered ceramic resistor. By thus fixing the sintered ceramic resistor on the sealing portion for fixing the center electrode, no additional sealing terminal is needed, but the length of the sintered ceramic resistor can be sufficiently enlarged to improve the noise preventing effect.

Preferably, in the spark plug of the invention, the distance between the rear end of the center electrode and the leading end of said sintered ceramic resistor is 0.5 mm to 1.5 mm. Since the distance between the rear end of said center electrode and the leading end of the sintered ceramic resistor is 15 mm or less, the sintered ceramic resistor comes closer to the center electrode side (on the ignition portion) to thereby further improve the noise preventing effect. Since the distance between the rear end of the center electrode and the leading end of said sintered ceramic resistor is 0.5 mm or more, on the other hand, it is possible to maintain the fixing forces of the center electrode and the sintered ceramic resistor.

Preferably, in the spark plug of the invention, the sealing portion includes a filling portion filled in the space between the leading end side outer circumference of the sintered ceramic resistor and the inner circumference of said second portion of the through hole, and the filling portion extends within an axial distance of 10 mm or less from the leading end of the sintered ceramic resistor. Since the sealing portion includes a filling portion filled in the space between the leading end side outer circumference of the sintered ceramic resistor and the inner circumference of the second portion of the through hole, the sintered ceramic resistor can be more reliably fixed by the sealing portion. Moreover, this fixture can be made even more reliable by increasing the axial distance of the filling portion. As the distance of the filling portion having a low resistance is made longer, the sintered ceramic resistor corresponding to the filler functions less as a resistor, so that the axial length of the sintered ceramic resistor to be used is substantially shortened. Therefore, the noise preventing effect is deteriorated. By setting the axial distance of the filling portion to 10 mm or less, the sintered ceramic resistor can be reliably fixed at the sealing portion while retaining its axial length to the extent possible and suppressing a deterioration of the noise preventing effect.

Preferably, in the spark plug of the invention, in the sintered ceramic resistor, the leading end face and the side face in a section extending through the axis substantially define a right angle. As a result, the seal material for forming the sealing portion hardly enters the space between the leading end side outer circumference of the sintered ceramic resistor and the inner circumference of the through hole so that the axial distance of the filling portion can be easily set to 10 mm or less.

Preferably, in the spark plug of the invention, said sintered ceramic resistor has a sectional area of 90% or more of that of the second portion of the through hole, when cut in a section extending through the sintered ceramic resistor and normal to the axial direction. Since the sectional area of the sintered ceramic resistor is thus 90% or more of the sectional area of the second portion of the through hole, it is possible to attain a sufficient noise preventing effect. If less than 90% of the sectional area, a sufficient noise preventing effect may not be obtained. Moreover, the sectional area of the sintered ceramic resistor is preferably 95% or more of that of the second portion of the through hole.

Preferably, the spark plug of the invention further comprises an insulating member filled in the space between the rear end side outer circumference of the sintered ceramic resistor and the inner circumference of the second portion of the through hole. If a space is present between the sintered ceramic resistor and the inner circumference of the second portion of the through hole, the sintered ceramic resistor may be subject to vibration by vibration of the spark plug, and the sintered ceramic resistor may be cracked or broken. By filling the insulating member in that space, therefore, the sintered ceramic resistor can be protected from cracking or breaking. The insulating member is preferably made of glass.

Preferably, in the spark plug of the invention, the sintered ceramic resistor contains tin oxide as a conductive component. By using tin oxide as the conductive powder, the resistance of the sintered ceramic resistor can be easily adjusted to make it possible to reduce the effective dielectric constant and the capacitative discharge current occurring at ignition time, to thereby attain a sufficient noise preventing effect.

In the spark plug having the resistor provided in the through hole formed in the axial direction of the insulator, according to the invention, the through hole of the insulator is composed of a first portion and a second portion having a larger diameter. The resistor is made from a pre-sintered ceramic resistor having an axial length of 40% or more of the axial length of the second portion of the through hole, and is inserted from the outside of the second portion of the through hole and fixed. It is, therefore, possible to provide a spark plug having excellent productivity, durability and noise preventing effect.

DESCRIPTION OF REFERENCE NUMERALS

Figure 1:
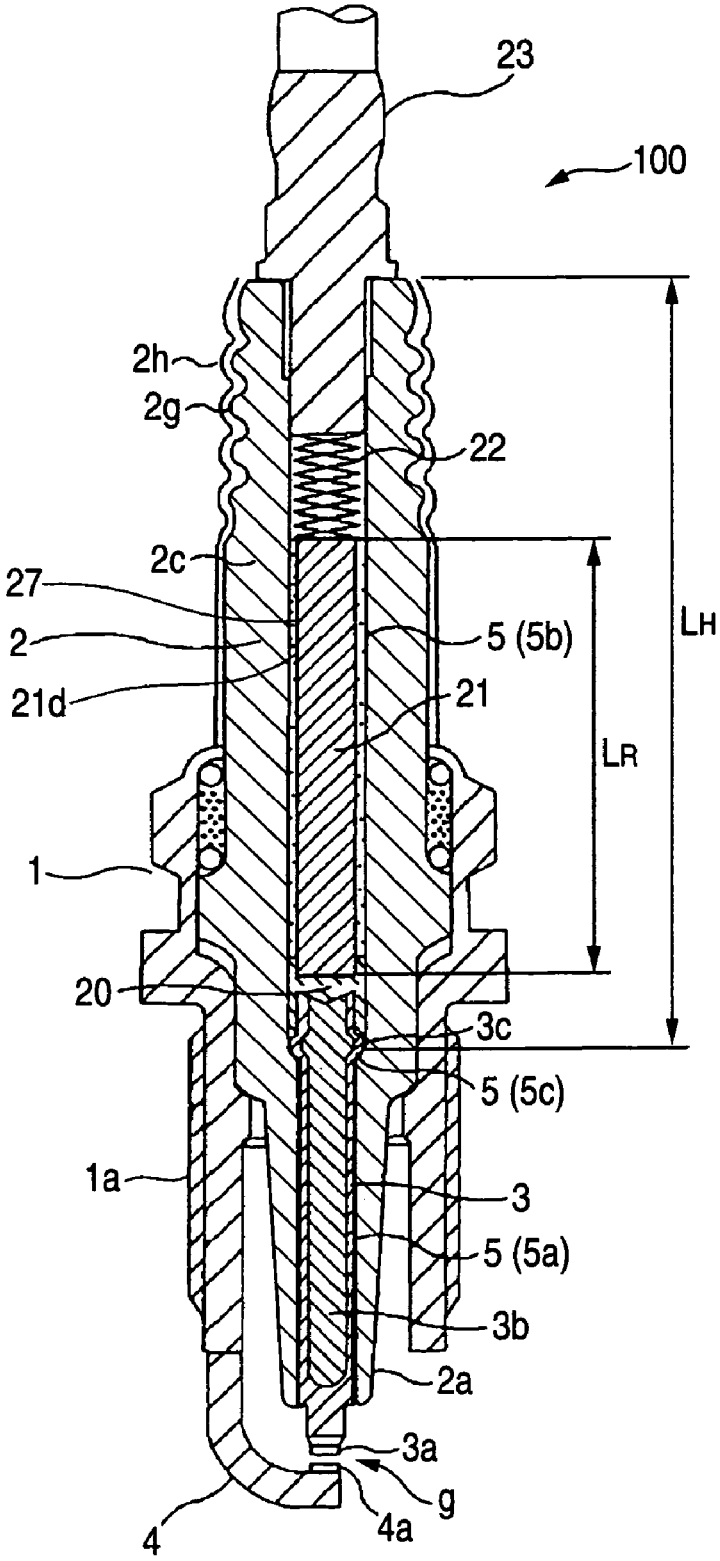
FIG. 1 is a sectional view showing one example of the spark plug of the invention.

Reference numerals used to identify various structural features in the drawings include the following:

1 - - - Metal Shell
2 - - - Insulator
3 - - - Center Electrode
4 - - - Earth Electrode
5 - - - Through hole
5*a* - - - First portion of the through hole
5*b* - - - Second portion of the through hole
20 - - - Conductive Seal Layer
21 - - - Sintered Ceramic Resistor
22 - - - Conductive Elastic Member,
23 - - - External Terminal
100 - - - Spark Plug.

DETAILED DESCRIPTION OF THE INVENTION

The invention will next be described by reference to the drawings. However, the present invention should not be construed as being limited thereto.

FIG. 1 shows one example of a spark plug 100 according to the invention. The spark plug 100 includes a cylindrical metal shell 1, an insulator 2 provided in the metal shell 1 and having a leading end portion 2*a* protruding from the metal shell 1, and a center electrode 3 provided in the insulator 2 and having an ignition portion 3*a* protruding from the insulator 2. In the center electrode 3, there is an embedded core member 3*b* for promoting heat release. Here in this embodiment, the lower side of the drawing is located on the leading end side, and the upper side of the drawing is located on the rear end side.

The metal shell 1 is provided at its leading end portion with an earth electrode 4, which is jointed at one end by a welding method or the like and bent back sideway at its other end side so that an ignition portion 4*a* provided on its side face confronts the ignition portion 3*a* of the center electrode 3 through a spark discharge gap g. A core member may be embedded in the earth electrode 4.

The earth electrode 4 and the center electrode 3 described above are made mainly of an Ni alloy, a Fe alloy or the like. The core member 3*b* embedded in the center electrode 3 for promoting heat release is made, for example, from Cu or a Cu alloy. The ignition portion 3*a* of the center electrode 3 and the ignition portion 4*a* of the confronting earth electrode 4 are made mainly of a precious metal alloy composed mainly of one or two kinds of Ir, Pt and Rh, for example.

The insulator 2 is made of an insulating material composed mainly of alumina and has a through hole 5 extending in the axial direction. Specifically, the insulator 2 is made from a sintered alumina ceramic body containing 80 to 98 mol. % (desirably 90 to 98 mol. %) of an Al component, as converted into $Al_2O_3$.

The component other than Al may be one or two kinds within the following range:

Si Component: 1.50 to 5.00 mol. % in terms of $SiO_2$;
Ca Component: 1.20 to 4.00 mol. % in terms of CaO;
Mg Component: 0.05 to 0.17 mol. % in terms of MgO;
Ba Component: 0.15 to 0.50 mol. % in terms of BaO; and
B Component: 0.15 to 0.50 mol. % in terms of $B_2O_3$.

Here, at the rear end portion of the outer circumference of a body portion 2*c*, a corrugated portion 2*g* is formed, which has a graze layer 2*h* on its outer circumference.

The through hole, 5 of the insulator 2 has a first substantially cylindrical portion 5*a* for inserting and fixing the center electrode 3, and a second substantially cylindrical portion 5*b* formed with a larger diameter on the rear end side of the first portion 5*a*. These first portion 5*a* and second portion 5*b* are connected to each other through a connecting portion 5*c* having a taper face or an arcuate face. The center electrode 3 is provided on its rear end side with an electrode fixing bulging portion 3*c*, which bulges outward from the outer circumference. At its electrode fixing bulging portion 3*c*, the center electrode 3 contacts the connecting portion 5*c* having the taper face or the arcuate face.

Here, the length of the second portion of the through hole 5*b* is designated by LH, as shown in FIG. 1. Rigorously, the length (LH of the second portion of the through hole 5*b* is a length from the rear end side end portion of the connecting portion 5*c* between the first portion 5*a* and the second portion 5*b* to the rear end side end portion of the second portion 5*b*.

In the second portion 5*b*, the center electrode 3 is provided on its rear end side with a sintered ceramic resistor 21 having a columnar shape through a conductive seal layer 20. Moreover, the sintered ceramic resistor 21 is provided on its rear end side with an external terminal 23 through a conductive elastic member 22 such as a spring. These center electrode 3, conductive seal layer 20, sintered ceramic resistor 21, conductive elastic member 22 and external terminal 23 are electrically connected with one another. Here, the axial length of the sintered ceramic resistor 21 inserted into the second portion 5*b* is designated by LR. Here, the conductive seal layer corresponds to the "sealing portion".

The sintered ceramic resistor 21 in the spark plug 100 is prepared by inserting a sintered body in advance into the through hole 5 (i.e., the second portion 5*b*) of the insulator 2, and has a length (LR) at least 40% of the length (LH) of the second portion, that is, $(LR/LH)\times 100 \geqq 40$.

In the invention, the resistor is prepared by inserting a pre-sintered ceramic resistor 21 into the through hole 5 (i.e., the second portion 5*b*) of the insulator 2 so that the sintered ceramic resistor 21 can be sufficiently elongated without sacrificing strength different from the manufacturing method of the prior art. As a result, the effective dielectric constant between the center electrode 3 and the external terminal 23 can be lowered to reduce the capacitative discharge current occurring at ignition time and to enhance the noise preventing effect.

Moreover, the length (LR) of the sintered ceramic resistor 21 is set to at least 40% of the length (LH) of the second portion 5*b* (that is, $(LR/LH)\times 100 \geqq 40$). As a result, the effective dielectric constant between the center electrode 3 and the external terminal 23 can be lowered to reduce the capacitative discharge current occurring at ignition time and to sufficiently enhance the noise preventing effect. The length (LR) of the preferred sintered ceramic resistor 21 is at least 50% of the length (LH) of the second portion 5*b* (that is, (LR/LH)×100≧40).

Here, the length (LR) of the sintered ceramic resistor 21 is preferably made longer for providing a higher noise preventing effect and is made closer to the length LH excepting the minimum lengths necessary for the conducive elastic member 23, the external terminal 23 and so on.

Moreover, the rear end portion 3*d* closer to the rear end side than the electrode fixing bulging portion 3*c* of the center electrode 3 and the sintered ceramic resistor 21 are fixed by the conductive seal layer 20. See FIG. 2. Since the sintered ceramic resistor 21 is thus further fixed to the conductive seal layer 20 for fixing the center electrode 3, the length of the sintered ceramic resistor 21 can be made sufficient for improving the noise preventing effect without requiring a sealing terminal or the like.

Figure 2:
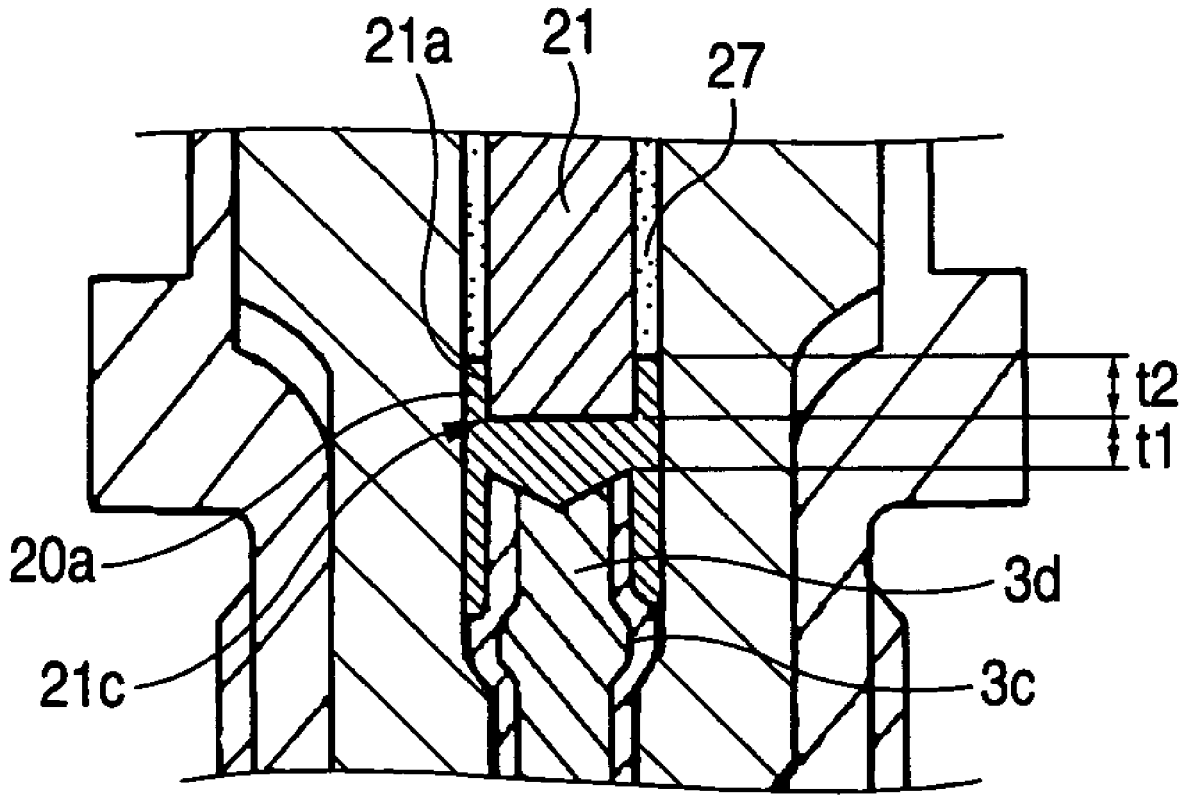
FIG. 2 is a partially enlarged section of the spark plug of the invention.

Moreover, referring to FIG. 2, the distance t1 between the rear end of the center electrode 3 and the leading end of the sintered ceramic resistor 21 is 0.8 mm. Thus, the distance t1 between the rear end of the center electrode 3 and the leading end of the sintered ceramic resistor 21 is 1.5 mm or less so that the sintered ceramic resistor 21 comes closer to the center electrode side (the side of the ignition portion) so that the noise preventing effect is further improved. On the other hand, the distance between the rear end of the center electrode and the leading end of the sintered ceramic resistor is 0.5 mm or more so that good adhesion between the center electrode and the sintered ceramic resistor can be maintained.

Moreover, the space between the outer circumference 21*a* on the leading end side of the sintered ceramic resistor 21 and the inner circumference of the second portion 5*b* is filled with a filling portion 20*a* of the conductive seal layer 20. Thus, the filling portion 20*a* is present in the space between the outer circumference of the leading end side of the sintered ceramic resistor 21 and the inner circumference of the second portion 5*b* so that the sintered ceramic resistor 21 can be reliably fixed by the conductive seal layer 20.

Moreover, the filling portion 20*a* has an axial distance t2 of 7 mm from the leading end of the sintered ceramic resistor 21. Thus, the axial distance t2 of the filling portion 20*a* is 10 min or less so that the sintered ceramic resistor 21 can retain an axial length as long as possible to fix the sintered ceramic resistor 21 reliably with the conductive seal layer 20 while suppressing a decrease in the noise preventing effect.

Moreover, a corner portion 21*c*, which is defined by the leading end face and the side face of the sintered ceramic resistor 21, is substantially a right angle. This configuration makes it difficult for the seal material forming the conductive seal layer 20 to enter the space between the outer circumference 21*a* of the leading end side of the sintered ceramic resistor 21 and the inner circumference of the second portion 5*b*. Thus, the axial distance t2 of the filling portion 20*a* can be easily made 10 mm or less.

The sectional area of the sintered ceramic resistor 21 of the invention is preferably 90% or more than that of the second portion 5*b*, although it is always limited thereto. If less than 90%, a sufficient noise preventing effect may not be obtained. The sectional area of the sintered ceramic resistor 21 is preferably 95% or more of the sectional area of the second portion 5*b*.

Moreover, a glass member 27 is interposed in the space between the outer circumference 21*d* of the sintered ceramic resistor 21 and the inner circumference of the second portion 5*b*. Thus, the glass member 27 is filled in the space between the outer circumference 21 d of the rear end side of the sintered ceramic resistor 21 and the inner circumference of the second portion 5*b*, so that the sintered ceramic resistor 21 is protected from cracks or breaks due to vibration. Here, this glass member corresponds to the "insulating material".

The conductive seal layer 20 comprises a glass powder and a conductive powder. The glass powder is constituted by an oxide of $B_2O_3$—$SiO_2$, BaO—$B_2O_3$, $SiO_2$—$B_2O_3$—CaO—BaO, $SiO_2$—ZnO—$B_2$—$O_3$, $SiO_2$—$B_2O_3$—$Li_2O$, and $SiO_2$—$B_2O_3$—$Li_2O$—BaO, for example, and the conductive powder is composed mainly of one kind or two or more kinds selected from metal components consisting of Cu, Fe and Sn. The conductive seal layer 20 may contain, as needed, a semiconductive inorganic chemical powder or insulating powder such as $TiO_2$ or the like.

The content of the conductive powder in the conductive seal layer 20 is preferably 35 wt. % or more and 70 wt. % or less. If the content of the conductive powder is 30 wt. % or less, the content of the conductive powder forming the network-shaped conductive passage in the conductive seal layer 20 is too small to retain adequate conductivity. If the content of the conductive powder is 70 wt. % or more, the conductive powder has too high a thermal expansion coefficient such that the thermal expansion coefficient of the conductive seal layer 20 may become so high as to cause peeling or cracking.

The sintered ceramic resistor 21 is prepared by sintering mainly an aggregate and the conductive powder. The aggregate can be exemplified by one or two of the glass powder or the insulating ceramic powder.

Examples of the glass powder include one kind or two or more kinds of $B_2O_3$—$SiO_2$, BaO—$B_2O_3$, $SiO_2$—$B_2O_3$—CaO—BaO, $SiO_2$—ZnO—$B_2O_3$, $SiO_2$—$B_2O_3$—$Li_2O$, and $SiO_2$—$B_2O_3$—$Li_2O$—BaO.

The insulating ceramic powder is exemplified by one kind or two or more kinds of alumina, silicon nitride, mullite or steatite.

The conductive powder may be exemplified by one kind or two or more kinds of a semiconductor oxide, a metallic or a nonmetallic conductive material.

Examples of the semiconductor oxide include a tin oxide, zinc, antimony, tin, silver or nickel as the metal, amorphous carbon (or carbon black), graphite, silicon carbide, titanium carbide, tungsten carbide or zirconium carbide as the nonmetallic material. The individual materials, as exemplified by those semiconductor oxides, metals and nonmetallic conductive materials, may be one kind or two or more kinds.

The sintered ceramic resistor 21 of the invention can make use of the aforementioned individual components selectively, but preferably is made of steatite as the aggregate and tin oxide as the conductive powder, for example. With this combination, the resistance of the sintered ceramic resistor 21 can be easily adjusted to reduce the effective dielectric constant and the capacity discharge current produced at ignition time, to thereby achieve a sufficient noise preventing effect. The resistance of the sintered ceramic resistor 21 in the invention is preferably 2 KΩ or more and 8 KΩ or less, and is more preferably 4 KΩ or more and 6 KΩ or less.

Next, one example of the process for manufacturing the spark plug 100 is described. First, preparation of the conductive seal powder for forming the sintered ceramic resistor 21 and the conductive seal layer 20 for use in the manufacture of the spark plug 100 is described.

The sintered ceramic resistor 21 is prepared by adding a binder to a predetermined amount of a blend of a predetermined aggregate and a conductive powder, by mixing the blend sufficiently in a solvent and by drying the mixture to produce a resistor composite powder. This resistor composite powder is then used to form a press molding by a press molding method used in fabrication of the aforementioned insulator 2. The press molding is sintered and treated to a predetermined shape to prepare the sintered ceramic resistor 21. A glass material for the glass member 27 is applied to the rear end side outer circumference 21d of the sintered ceramic resistor 21.

Here, the length (LR) of the sintered ceramic resistor 21 is set to 40% or more of the length (LH) of the second portion of the insulator 2. Moreover, the resistance of the sintered ceramic resistor 21 is adjusted to a predetermined resistance value by changing the composition of the resistor composite powder.

Moreover, the preparation of the conductive seal powder for forming the conductive seal layer 20 is exemplified by blending the base glass powder and the conductive powder in a predetermined composition, for example, and by mixing and dispersing the blend homogeneously.

Next, assembly of the center electrode 3, the sintered ceramic resistor 21 and the external terminal 23 with the insulator 2 is described as follows. Assembly of the center electrode 3 and the sintered ceramic resistor 21 with the insulator 2 is performed by a glass sealing step, as will be described in the following.

At first, glaze slurry is sprayed and applied from a spray nozzle to the insulator 2, and the insulator 2 is dried to form a glaze slurry applied layer 2*ha* (FIG. 3) to become the glaze layer 2*h* of FIG. 1.

Figure 3:
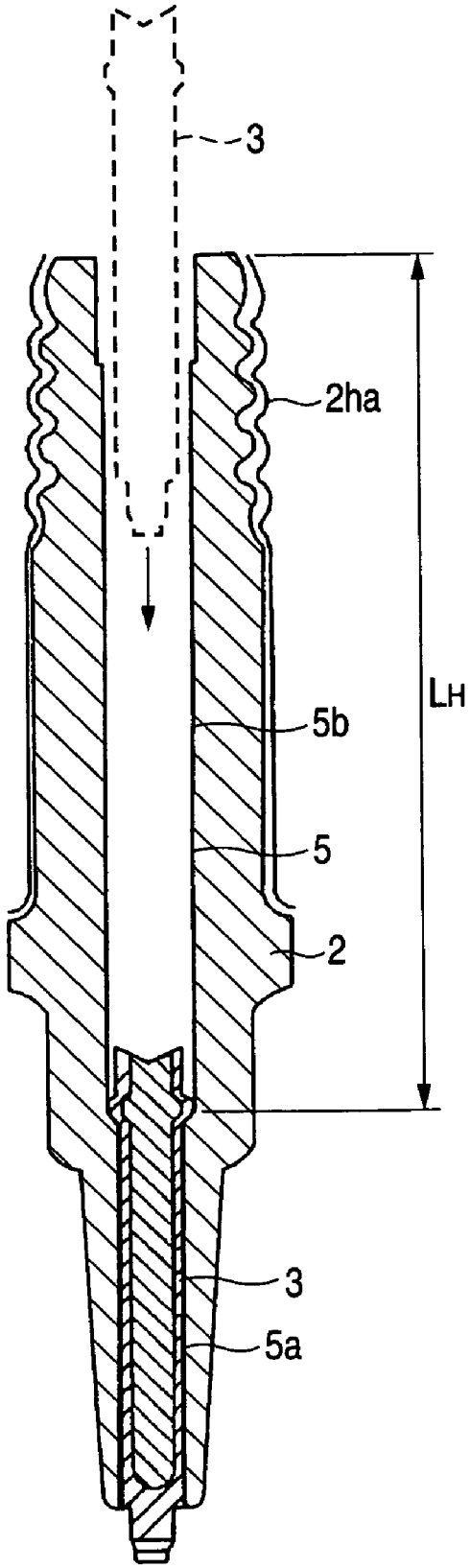
FIG. 3 is a sectional view showing one example of a step of manufacturing the spark plug of the invention.
Figure 4:
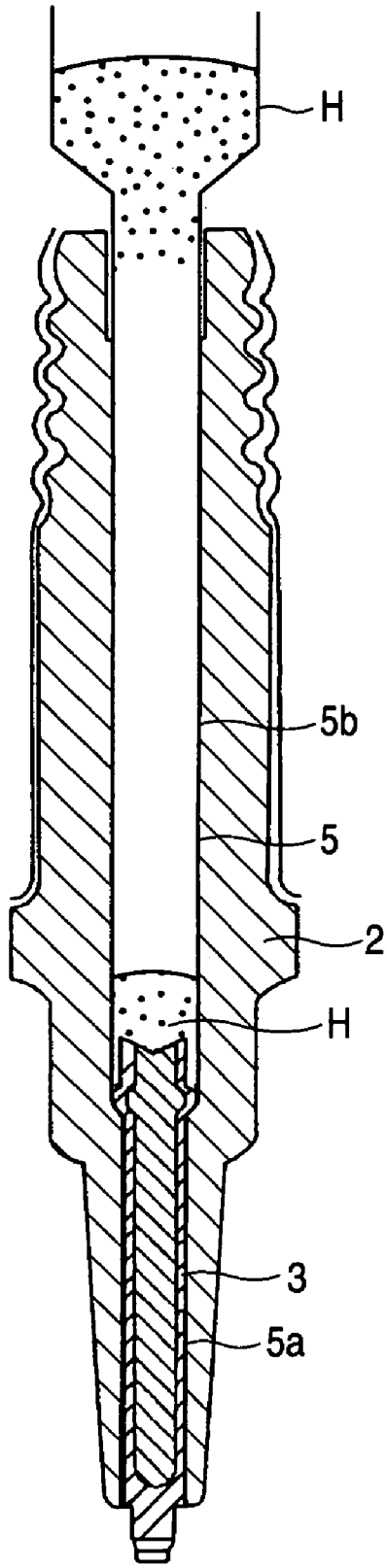
FIG. 4 is a sectional view showing one example of a step of manufacturing the spark plug of the invention.
Figure 5:
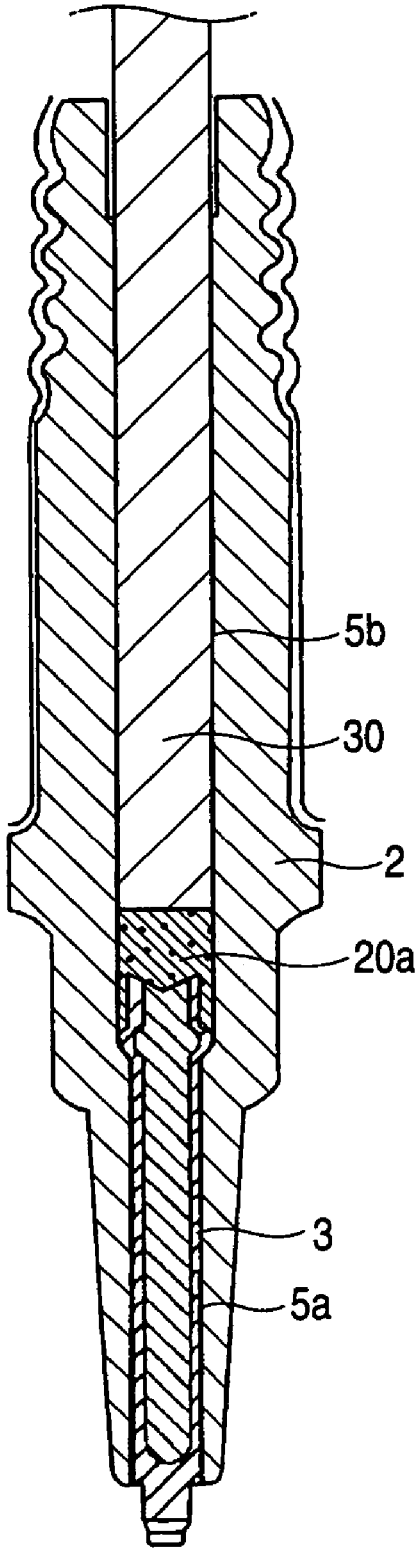
FIG. 5 is a sectional view showing one example of a step of manufacturing the spark plug of the invention.

Next, the center electrode 3 is inserted into the first portion 5*a* of the through hole 5 of the insulator 2 having the glaze slurry applied layer 2*ha*, as shown in FIG. 3. As shown in FIG. 4, moreover, the center electrode 3 in the second portion 5*b* is filled on its rear end side with the aforementioned conductive seal powder H. As shown in FIG. 5, moreover, a holding rod 30 is inserted into the second portion 5*b* to compress the filled conductive seal powder H preparatorily to thereby form the conductive seal powder layer 20*a*.

Figure 6:
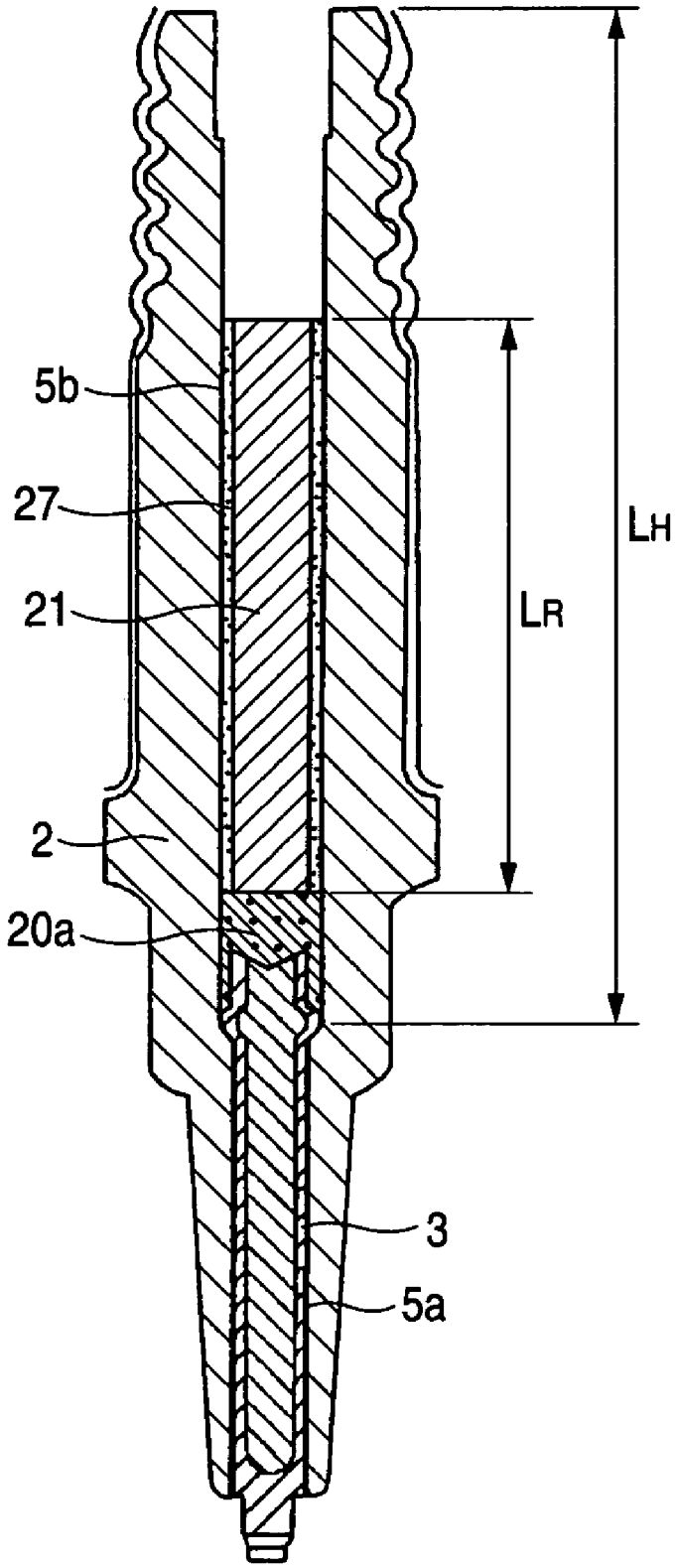
FIG. 6 is a sectional view showing one example of a step of manufacturing the spark plug of the invention.

Next, as shown in FIG. 6, the sintered ceramic resistor 21, which is formed to have a predetermined shape by press-molding and sintering the resistor composite powder, is inserted from the rear end side of the insulator 2 into the second portion 5*b* to thereby bring the conductive seal powder layer 20*a* and the sintered ceramic resistor 21 into contact with each other.

Figure 7:
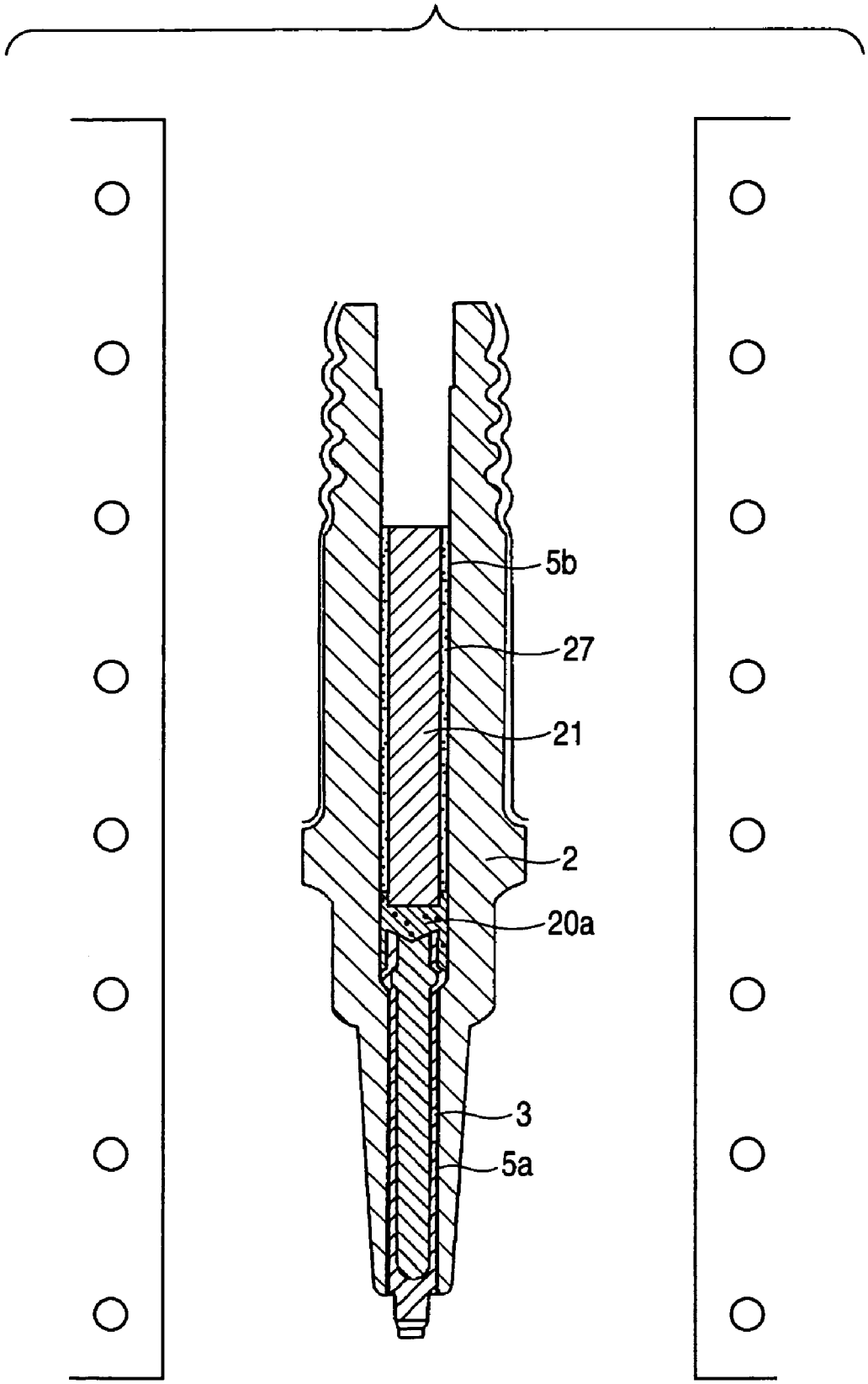
FIG. 7 is a sectional view showing one example of a step of manufacturing the spark plug of the invention.

In this state, as shown in FIG. 7, the sintered ceramic resistor 21 is inserted into a heating oven so that it is heated to a predetermined temperature of 700 to 950° C. After this, the sintered ceramic resistor 21 is press-fitted from the rear end side in the through hole 5 to the leading end side of the axial direction. At the same time, the glass member 27 is formed in the space between the outer circumference 21d of the rear end side of the sintered ceramic resistor 21 and the inner circumference of the second portion 5*b*.

Figure 8:
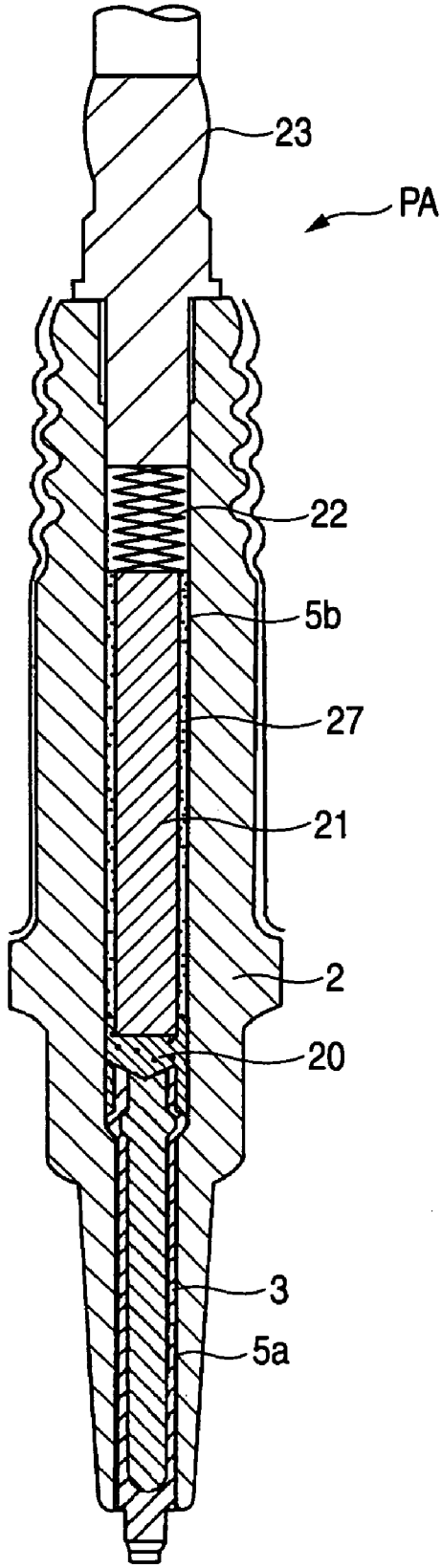
FIG. 8 is a sectional view showing one example of a step of manufacturing the spark plug of the invention.

Into the insulator 2 thus having the sintered ceramic resistor 21 fixed by the conductive seal layer 20, as shown in FIG. 8, the conductive elastic member 22 is inserted from the rear end side of the through hole 5, and the external terminal 23 is mounted to form an assembly PA. This assembly PA is further assembled with the metal shell 1, the earth electrode 4 and so on to manufacture the spark plug 100, as shown in FIG. 1. The spark plug 100 thus manufactured is attached at its threaded portion 1*a* to the engine block so that it is employed as the ignition source for a mixture to be fed to the combustion chamber.

The spark plug 100 of the invention has been described above, but its constitution can be suitably changed without departing from the gist of the invention. In the above embodiment, for example, the glass member 27 is applied in advance to the sintered ceramic resistor 21, and the space is formed between the rear end side outer circumference 21*d* and the inner circumference of the second portion 5*b* of the sintered ceramic resistor 21 when this sintered ceramic resistor 21 is to be assembled with the insulator 2 at the glass sealing step. The invention is not limited thereto, in that, for example, the glass member 27 may also be formed by performing the glass sealing step without applying the glass member 27 in advance to the sintered ceramic resistor 21 and then by filling the softened glass material in the space between the rear end side outer circumference 21*d* and the inner circumference of the second portion 5*b* of the sintered ceramic resistor 21.

EXAMPLES

The invention is described in the following in connection with the following examples.

Examples 1 to 3

At first, the metal powder composed of Cu powder and Fe powder (both having an average particle diameter of 30 μm) blended at a mass ratio of 1:1 were mixed so that the content of the metal powder was about 50 wt. %, to prepare the conductive seal powder H.

After the center electrode 3 had been inserted into the first portion 5*a* of the insulator 2, the conductive seal powder H was filled in the second portion 5*b* on the rear end side of the center electrode 3 and was preparatorily compressed by the, holding rod 30 to form the conductive seal powder layer 20*a*.

Next, the sintered ceramic resistor 21, composed mainly of steatite as the aggregate and tin oxide as the conductive powder and which had a length (LR) adjusted to 40% or more of the length (LH) of the second portion 5*b*, was inserted into the through hole 5*b* of the insulator 2 on the rear end side of the conductive seal powder layer 20*a*. After these were inserted into the heating oven, they were heated to 90° C., and the sintered ceramic resistor 21 was press-fitted to the axial leading end side of the through hole 5 from the rear end side.

Here, the length (LR) of the sintered ceramic resistor 21 according to Example 1 was set to 61% of the length (LH) of the second portion 5*b*. Likewise, the length (LR) of the sintered ceramic resistor 21 according to Example 2 was set to 50%, and the length (LR) of the sintered ceramic resistor 21 according to Example 3 was set to 40%. The sectional areas and resistances of the individual sintered ceramic resistors 21 according to Embodiments 1 to 3 were equalized so that the sectional areas were set to 97% of that of the second portion 5*b*, and the resistances were set to 5 KΩ.

Into the insulator 2 having the center electrode 3 and the sintered ceramic resistor 21 fixed thereto, moreover, a spring was inserted as the conductive elastic member 22 from the rear end side of the through hole 5, and the external terminal 23 was further mounted to form the assembly PA Moreover, the metal shell 1, the earth electrode 4 and so on were assembled with that assembly PA into the spark plug 100.

Comparative Examples 1 and 2

A spark plug was manufactured by a method similar to that of Example 1. Here, the length (LR) of the sintered ceramic resistor according to Comparative Example 1 was set to 37% of the length LH) of the second portion, and the length (LR) of the sintered ceramic resistor according to Comparative Example 2 was set to 33%. The sectional areas and resistances of the individual sintered ceramic resistors according to Comparative Examples 1 and 2 were equalized so that the sectional areas were set to 97% of that of the second portion, and the resistances were set to 5 KΩ.

Comparative Example 3

Figure 9:
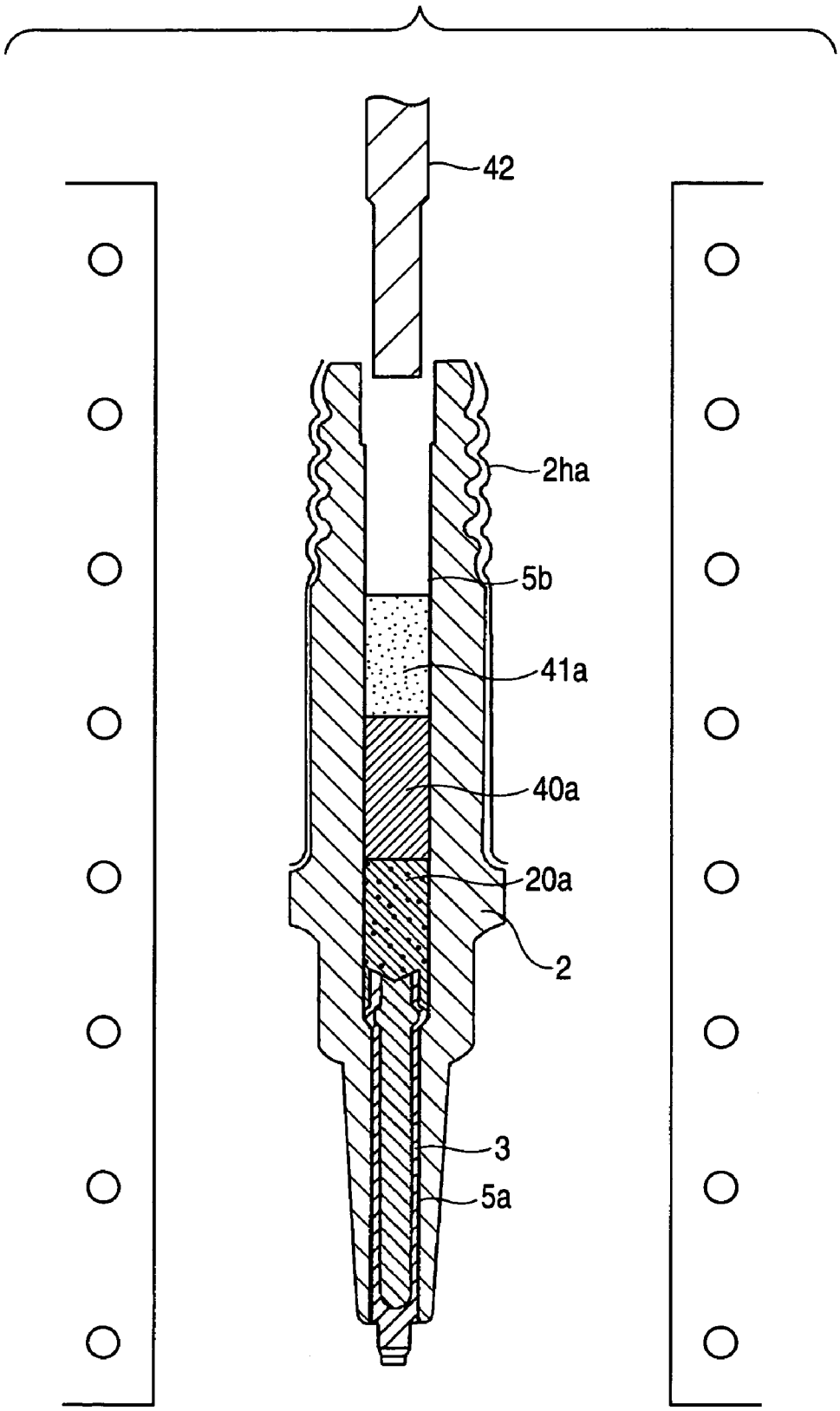
FIG. 9 PRIOR ART
FIG. 9 is a sectional view showing one example of a step of manufacturing a monolithic type spark plug of the prior art.

The center electrode 3 was inserted into the insulator 2 as in Example 1, as shown in FIG. 9. After this, the conductive seal powder, the resistor composite powder and the conductive seal powder were sequentially filled and preparatorily compressed by the holding rod to thereby laminate the first conductive seal powder layer 20*a*, a resistor composite powder layer 40*a* and a second conductive seal powder layer 41*a*.

Here, the composition of the conductive seal powder used to form the first conductive seal layer 20*a* and the second conductive seal powder layer 41*a* was made similar to that of the conductive seal powder of Example 1, and the quantity of the conductive seal powder used to form the first conductive seal powder layer 20*a* was equal to that used in Example 1.

The resistor composite powder used to form the resistor composite powder layer 41*a* was similar to that used to fabricate the sintered ceramic resistor of Example 1. The quantity of the resistor composite powder used to fabricate the resistor composite powder layer 40*a* was one which can generally be used in a manufacturing method of this kind.

Figure 10:
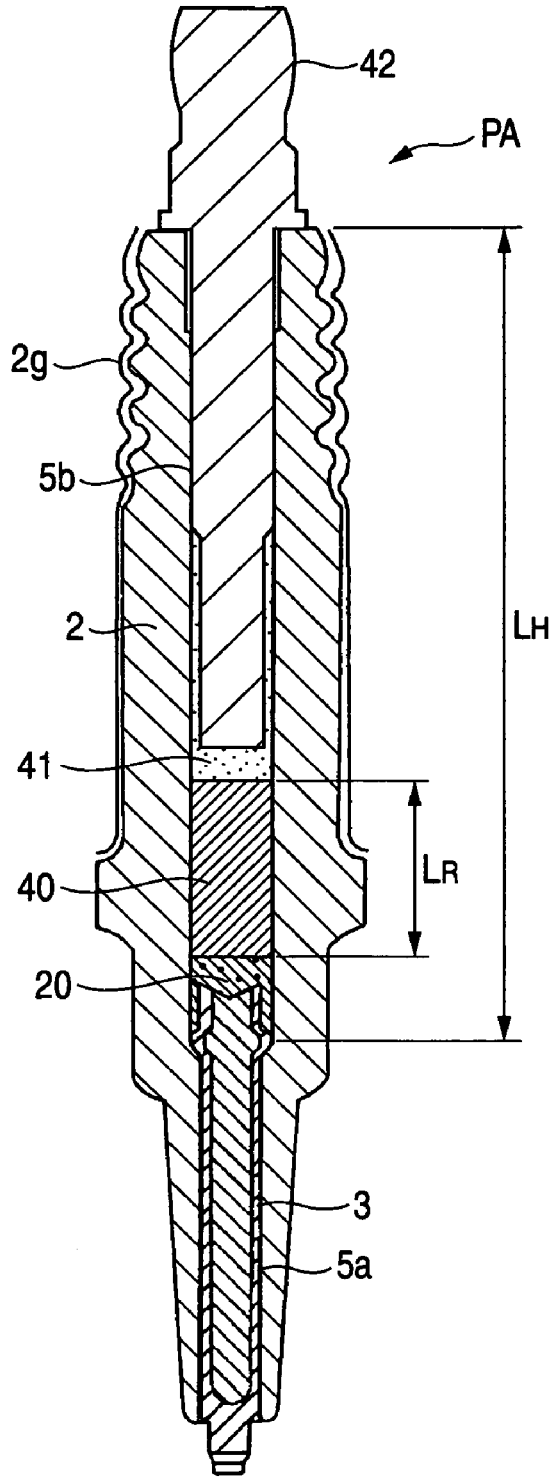
FIG. 10 PRIOR ART
FIG. 10 is a sectional view showing one example of a step of manufacturing a monolithic type spark plug of the prior art.

Next, heating treatment was conducted at 900° C., and an external terminal 42 was press-fitted in the through hole 5 of the insulator 2 from the rear end side, as shown in FIG. 9. The individual layers of the laminated state were axially pressed to fabricate the assembly PA including a first conductive seal layer 20, a resistor 40 and a second conductive seal layer 41, as shown in FIG. 10. After this, the main fitting and so on were attached to the assembly PA to manufacture the spark plug. Here, the length (LR) of the resistor 40 in the spark plug thus obtained was 22% of the length (LH) of the second portion 5*b*, and the resistance of the resistor 40 was 5 KΩ.

Comparative Example 4

Figure 11:
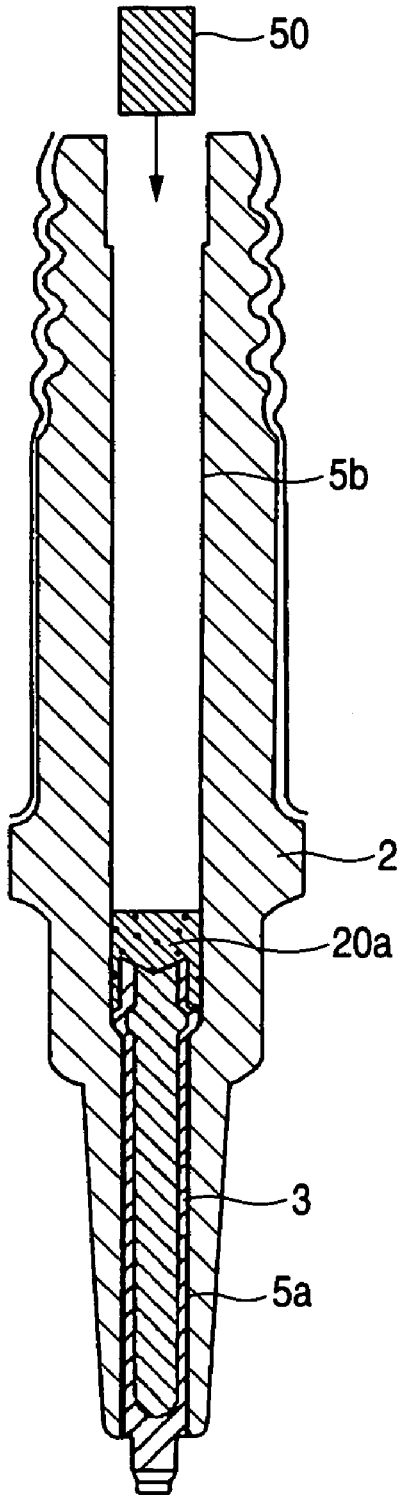
FIG. 11 PRIOR ART
FIG. 11 is a sectional view showing one example of a step of manufacturing a spark plug using a coil resistor of the prior art.
Figure 12:
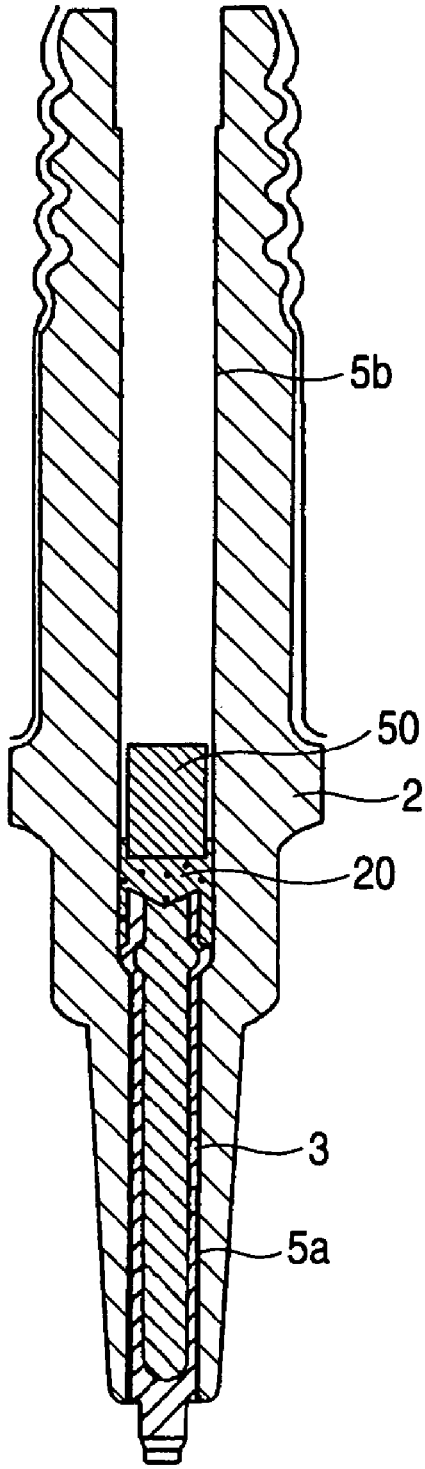
FIG. 12 PRIOR ART
FIG. 12 is a sectional view showing one example of a step of manufacturing a spark plug using the coil resistor of the prior art.

The center electrode 3 was inserted into the insulator similar to Example 1, and a conductive seal powder similar to that of Example 1 was filled and preparatorily compressed by the holding rod to prepare the conductive seal powder layer 20*a*. As shown in FIG. 11, a sealing terminal 50 was inserted into the through hole 5 of the insulator 2 from the rear end side, to thereby bring the conductive seal powder layer 20*a* and the sealing terminal 50 into contact with each other. In this state, the assembly was inserted into the heating oven and was heated to 900° C. After this, the sealing terminal 50 was press-fitted from the rear end side in the through hole 5 of the sealing terminal 50 to the leading end side in the axial direction, to thereby fix the conductive seal layer 20 and the sealing terminal 50, as shown in FIG. 12.

Figure 13:
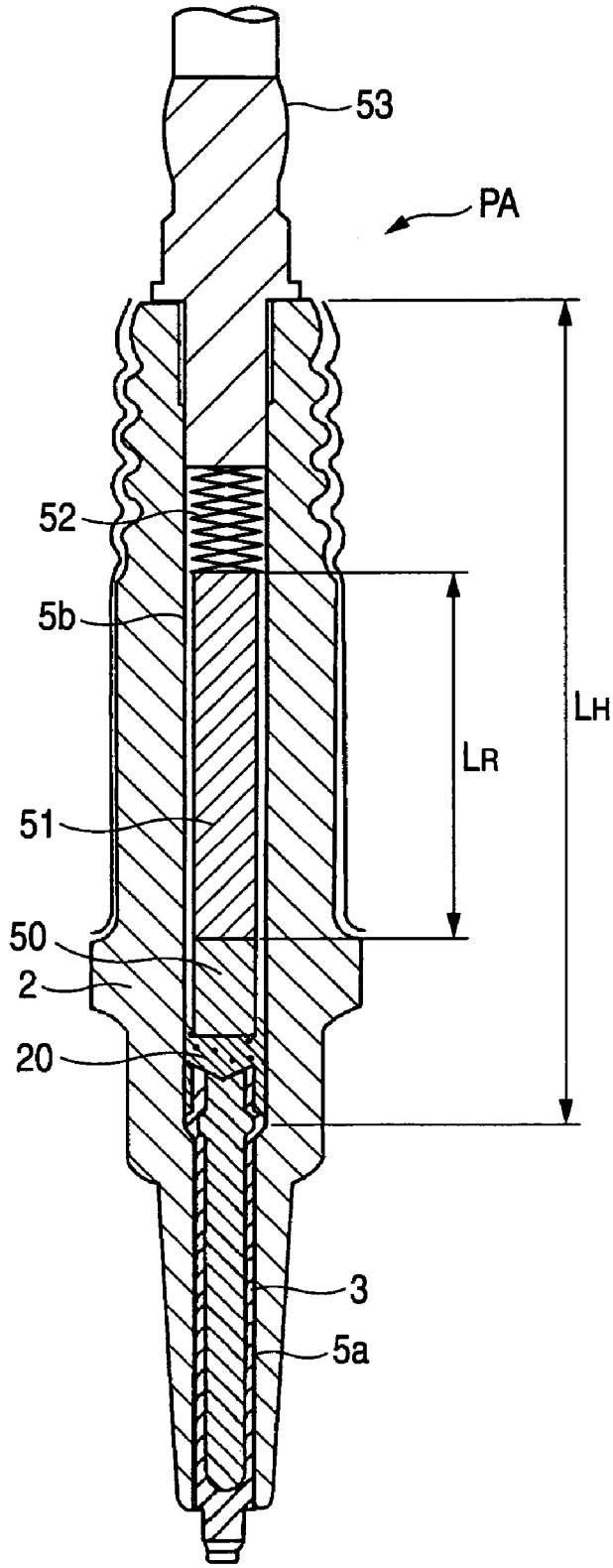
FIG. 13 PRIOR ART
FIG. 13 is a sectional view showing one example of a step of manufacturing a spark plug using the coil resistor of the prior art.

After this, a coil resistor 51 was inserted into the through hole 5 of the insulator 2 from the rear end side, as shown in FIG. 13. After this, a spring 52 and an external terminal 53 were mounted to form the assembly PA The main fitting and so on were attached to the assembly PA to manufacture the spark plug. Here, the length (LR) of the coil resistor 51 was 31% of the length (LH) of the second portion 5*b*. Moreover, the resistance of the coil resistor 51 was 0.05 KΩ.

Table 1 enumerates the types of the resistors used in Examples 1 to 3 and Comparative Examples 1 to 4, the lengths of the second portions of the insulators, the ratios (LR/LH×100 [%]) of the lengths of the resistors to the lengths of the second portions of the insulators, and the resistances of the resistors.

TABLE 1

| | | Type of Resistor | Length of Second portion of the through hole (LH) [mm] | Length of Resistor (LR) [mm] | Resistor Length/Second portion of the through hole (LH/LR × 100)(%) | Resistance of Resistor (KΩ) |
|---|---|---|---|---|---|---|
| Example | 1 | Insertion of Sintered body | 45 | 27.5 | 61 | 5.0 |
| | 2 | Insertion of Sintered body | 45 | 22.5 | 50 | 5.0 |
| | 3 | Insertion of Sintered body | 45 | 18 | 40 | 5.0 |
| Comparative Example | 1 | Insertion of Sintered body | 45 | 16.5 | 37 | 5.0 |
| | 2 | Insertion of Sintered body | 45 | 15 | 33 | 5.0 |
| | 3 | Monolithic | 45 | 10 | 22 | 5.0 |
| | 4 | Coil Resistor | 45 | 14 | 31 | 0.05 |

Next, the noise preventing effect and durability of the spark plugs of Examples 1 to 3 and Comparative Example 1 to 4 were evaluated. The results are enumerated in Table 2.

Here, the evaluations of the noise preventing effect were made based on the Current Method JASO D 004-91 (established by The Society of Automotive Engineers of Japan on Mar. 29, 1991) at frequencies of 30 Hz, 250 Hz and 750 Hz under a chamber pressure of 400 KPa and at an applied spark plug voltage of 12 KV.

In Table 2, the noise preventing effect was so judged for the entire frequency range with reference to the noise current intensity of the spark plug of Comparative Example 3 such that a noise current intensity lower by at least 7.5% than that of the spark plug of Comparative Example 3 was graded "○○", a noise current intensity lower by at least 5.0% and at most 7.5% was graded "○", and a noise current intensity lower by at most 5% was graded "Δ".

For the durabilities, the resistance changing rates over 200 hours were measured at an applied voltage of 20 KV of the spark plug and at a spark frequency of 60 Hz. In Table 2, the symbol "○" indicates a resistance changing rate of within ±50%, and the symbol "X" indicates that the resistance changing rate was over ±50%.

TABLE 2

| | | Noise Preventing Effect | | | | |
|---|---|---|---|---|---|---|
| | | Judge | Current Intensity (dBμA) for 30 Hz Noise | Current Intensity (dBμA) for 250 Hz Noise | Current Intensity (dBμA) for 750 Hz Noise | Durability |
| Example | 1 | ○○ | 72 | 48 | 38 | ○ |
| | 2 | ○○ | 72 | 49 | 45 | ○ |
| | 3 | ○ | 73 | 50 | 46 | ○ |
| Comparative Example | 1 | Δ | 75 | 54 | 47 | ○ |
| | 2 | Δ | 75 | 57 | 48 | ○ |
| | 3 | Reference | 78 | 57 | 49 | ○ |
| | 4 | ○○ | 74 | 49 | 45 | X |

As is apparent from Table 2: the noise preventing effect can be improved far more than that obtained from a monolithic type resistor spark plug of the prior art, by inserting the pre-sintered sintered ceramic resistor into the insulator and by setting the length (LR) of the sintered ceramic resistor to 40% or more of the length (LH) of the second portion 5*b*; and can be equal to or better than that obtained using a coil resistor generally accepted as exhibiting an excellent noise preventing effect. The above-noted results also show that the durability can be equivalent to that of the monolithic type resistor spark plug of the prior art.

It should further be apparent to those skilled in the art that various changes in form and detail of the invention as shown and described above may be made. It is intended that such changes be included within the spirit and scope of the claims appended hereto.

This application is based on Japanese Patent application JP 2004-297250, filed Oct. 12, 2004, the entire content of which is hereby incorporated by reference, the same as if set forth at length.

What is claimed is:

1. A spark plug comprising:

an insulator having a through hole extending in an axial direction, said through hole including a first portion and a second portion provided on a rear end side of said first portion and having a larger diameter than that of said first portion;

a center electrode provided in said first portion of the through hole of said insulator;

an external terminal provided in said second portion of the through hole of said insulator;

a sintered ceramic resistor provided in said second portion of the through hole, said sintered ceramic resistor comprising a sintered body of a conductive ceramic, connecting said center electrode and said external terminal electrically, and having a length in an axial direction being 40% or more of a length in an axial direction of said second portion of the through hole; and a conductive sealing portion comprising a glass component and a conductive component, and fixing and electrically connecting a rear end of said center electrode and a leading end of said sintered ceramic resistor, wherein a distance between a rear end of said center electrode and a leading end of said sintered ceramic resistor is 0.5 mm to 1.5 mm.

2. The spark plug as claimed in claim 1, wherein said conductive sealing portion includes a filling portion filled in a space between a leading end side outer circumference of said sintered ceramic resistor and an inner circumference of said second portion of the through hole, and said filling portion extends to a region having a distance in an axial direction of 10 mm or less from a leading end of said sintered ceramic resistor.

3. The spark plug as claimed in claim 2, wherein a leading end face and a side face in a section extending through the axis of said sintered ceramic resistor substantially define a right angle.

4. The spark plug as claimed in claim 1, wherein said sintered ceramic resistor has a sectional area of 90% or more of that of said second portion of the through hole, when cut in a section extending through said sintered ceramic resistor and normal to said axial direction.

5. The spark plug as claimed in claim 1, further comprising an insulating member filled in a space between a rear end side outer circumference of said sintered ceramic resistor and an inner circumference of said second portion of the through hole.

6. The spark plug as claimed in claim 1, wherein said sintered ceramic resistor contains tin oxide as a conductive component.

7. A spark plug comprising:

an insulator having a through hole extending in an axial direction, said through hole including a first portion and a second portion provided on a rear end side of said first portion and having a larger diameter than that of said first portion;

a center electrode provided in said first portion of the through hole of said insulator;

an external terminal provided in said second portion of the through hole of said insulator;

a sintered ceramic resistor provided in said second portion of the through hole, comprising a sintered body of a conductive ceramic, connecting said center electrode and said external terminal electrically, and having a length in an axial direction being 40% or more of a length in an axial direction of said second portion of the through hole, and a conductive sealing portion comprising a glass component and a conductive component, and fixing and electrically connecting a rear end of said center electrode and a leading end of said sintered ceramic resistor; and wherein said conductive sealing portion includes a filling portion filled in a space between a leading end side outer circumference of said sintered ceramic resistor and an inner circumference of said second portion of the through hole, said filling portion extending to a region having a distance in an axial direction of 10 mm or less from a leading end of said sintered ceramic resistance.

* * * * *